US005970270A

United States Patent [19]

De Roeck

[11] Patent Number: 5,970,270

[45] Date of Patent: Oct. 19, 1999

[54] PHOTOGRAPHIC SHEET MATERIAL LIQUID PROCESSING APPARATUS AND PROCESS FOR CONSTRUCTING A SEALING RING

[75] Inventor: Luc De Roeck, Kontich, Belgium

[73] Assignee: Agfa-Gevaert, Mortsel, Belgium

[21] Appl. No.: 09/054,804

[22] Filed: Apr. 3, 1998

[51] Int. Cl.[6] ..... G03D 3/08

[52] U.S. Cl. ..... 396/612

[58] Field of Search ..... 396/612, 620, 396/636, 622; 430/399

[56] References Cited

U.S. PATENT DOCUMENTS

| | | | |
|---|---|---|---|
| 4,166,688 | 9/1979 | Sachs | 396/636 |
| 5,754,914 | 5/1998 | Van Den Bergen et al. | 396/612 |
| 5,861,236 | 1/1999 | Verlinden et al. | 430/399 |

FOREIGN PATENT DOCUMENTS

| | | |
|---|---|---|
| 0629914 | 12/1994 | European Pat. Off. . |
| 01131562 | 5/1989 | Japan . |
| 07064269 | 3/1995 | Japan . |

*Primary Examiner*—D. Rutledge
*Attorney, Agent, or Firm*—Baker & Botts, L.L.P.

[57] ABSTRACT

The apparatus includes a path-defining roller (28) and a sealing roller (38, 39) in contact therewith to seal the path-defining roller from the housing of the apparatus. A sealing ring (82) surrounds one end of the sealing roller and is urged into contact with a sealing surface (68). The sealing ring, in its relaxed condition, is undersized with respect to the sealing roller and when mounted on the sealing roller exhibits a flat face (96) to the sealing surface. The performance of the sealing is predicable and reliable.

9 Claims, 4 Drawing Sheets

PHOTOGRAPHIC SHEET MATERIAL LIQUID PROCESSING APPARATUS AND PROCESS FOR CONSTRUCTING A SEALING RING

DESCRIPTION

1. Field of the Invention

The present invention relates to an apparatus for the wet processing of photographic sheet material, such as X-ray film, pre-sensitised plates, graphic art film and paper, and offset plates.

2. Background of Invention

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit.

A photographic sheet material liquid processing apparatus has been proposed in European patent application EPA 95203465.0 (filed Dec. 13, 1995) comprising a housing in which a path-defining roller is mounted, biased towards a reaction surface (usually another path-defining roller) to form a nip there-between through which a sheet material path extends. A sealing roller is positioned in contact with the path-defining roller along the length thereof to seal the path-defining roller from the housing. By the use of a sealing roller in place of the more common stationary sealing member, the torque which needs to be applied to the path-defining roller can be significantly reduced. This reduces the power needed by the processor, reduces wear on the path-defining roller, reduces the mechanical deformation thereof and thereby extends the expected life time. This construction also improves the control of pressure distribution over the sheet material.

The ends of the sealing roller need to be in contact in a leak-free manner with a sealing surface, such as an end plate secured to, or located in a fixed position relative to, the housing of the apparatus. It is important that the sealing rollers are retained in these end plates in a leak-free manner. Sealing rings formed for example of PTFE, are therefore provided, one surrounding each end of the sealing roller and urged into contact with sealing surfaces perpendicular to the sealing roller axis. It is also important that the sealing rings are so constructed as to compensate for the wear thereof.

This previously proposed construction suffers from the disadvantage of relying on the creeping effect of the sealing ring material under pressure. It is found that creeping is not a continuous flow, due to internal mechanical resistances. This makes the performance of the sealing unpredictable and unreliable.

OBJECTS OF INVENTION

It is object of the present invention to overcome the aforesaid disadvantage in a simple and cost effective manner.

SUMMARY OF THE INVENTION

We have discovered that this objective, and other useful advantages, can be achieved when the sealing ring has a configuration which, in its relaxed condition, is undersized with respect to the sealing roller and when mounted on the sealing roller exhibits a flat face in the plane perpendicular to the sealing roller axis.

Thus, according to a first aspect of the invention, there is provided a photographic sheet material liquid processing apparatus comprising a housing, a path-defining roller mounted in the housing and biased towards a reaction surface to form a nip there-between through which a sheet material path extends, a sealing roller in contact with the path-defining roller along the length thereof to seal the path-defining roller from the housing, and a sealing ring which surrounds one end of the sealing roller and is urged into contact with a sealing surface, characterised in that the sealing ring has a configuration which, in its relaxed condition, is undersized with respect to the sealing roller and when mounted on the sealing roller exhibits a flat face in the plane perpendicular to the sealing roller axis.

A line contact between the sealing rollers and the sealing rings is preferred to a surface-to-surface contact. In one embodiment, the sealing ring which surrounds the end of the sealing roller is urged into line-to-surface sealing engagement with the surface of the sealing roller by a spring. It is possible that line contact between the sealing roller and the sealing ring need not extend circumferentially completely around the sealing roller, and indeed there would be an advantage in this line contact extending only part way around the sealing roller, but on the liquid side thereof. This construction makes the tolerances to which the sealing roller and the sealing rings are constructed less critical.

Preferably, the sealing ring has a composite structure, comprising a spring embedded in elastomeric material. The spring may be formed of a metal ring structure based on Cr—Ni wire or an open metal structure based upon a Cr—Ni thin plate. The sealing ring may have a composite structure comprising at least two discrete regions, namely a sealing roller contacting region formed of a material of relatively low friction, that is lower than that of the other region, and a sealing surface contacting region formed of a material of relatively high elasticity, that is higher than that of the other region. This construction has the advantage that two different functions are complied with, that is firstly the sealing against the sealing roller using the classical sealing characteristics of pressure against a contact surface, and secondly the sealing face of the sealing ring, perpendicular to the sealing roller axis, being flat. In such a manner this sealing surface can be brought into the same surface as the sealing holder. This is a necessary characteristic for the sealing ring, because this common surface also acts as a sealing surface for the top end of the path-defining roller.

The material of relatively low friction may be selected from fluorinated polymers such as PTFE, oxymethylene polymers, acrylic polymers and ether sulphone polymers. In particular, we prefer to use a material for this region of the sealing ring which has good "creeping" characteristics to compensate for the wear under spring pressure, such as sintered PTFE.

The material of relatively high elasticity may be selected from ethylene/propylene/diene terpolymers (EPDM), silicone rubber, polyurethane, thermoplastic rubber such as Santoprene (Trade Mark for polypropylene/EPDM rubber), styrene-butyl rubber, nitrile-butyl rubber, PFA and Fluor-Latex (FLC) materials.

The sealing surface may be constituted by an end plate fixed to the housing, through an aperture of which the sealing roller passes.

According to a second aspect of the invention, there is provided a process for forming a sealing ring for use with a sealing roller in a photographic sheet material liquid processing apparatus, comprising forming a ring-like member which may be undersized with respect to the sealing roller and which includes a cut out portion opening onto an end of the ring-like member, forcing the ring-like member over a mandrel having a size substantiality equal to the size of the sealing roller, that is having a size which may be closer to the size of the sealing roller than to the relaxed size of the sealing ring, and filling the cut out portion with elastomeric material so as to provide a sealing ring with a flat end face.

Where a spring is included in the sealing ring, this may be inserted while the sealing ring is in a deformed state positioned over the mandrel before, or while, the cut-out portions are being filled with elastomeric material.

The sealing ring may be removed from the mandrel and then fitted onto one end of the sealing roller. Alternatively, the sealing roller itself may be used as the mandrel.

After filling the cut out portion with the elastomeric material and while the ring-like member is positioned over the mandrel, the end of the ring-like member may be ground to provide the flat face.

In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. As a consequence of the straight path, the material sensitivity for scratches becomes independent of the stiffness and thickness of the material. The present invention can also be made use of in an apparatus of hybrid configuration, that is an apparatus having one or more vessels through which the sheet material passes along a generally vertical path, coupled to one or more vessels through which the sheet material passes along a generally horizontal path. In particular, a vertical-horizontal-vertical path may be employed, with an up-across-down or, more preferably, a down-across-up sheet material path direction. Although the bending of the sheet material in an apparatus of conventional horizontal configuration is seen as undesirable, this is less so where the sheet bending takes place under the surface of a liquid.

While the present invention is applicable to apparatus with either a horizontal, vertical or hybrid orientation, it is particularly applicable to a vertical apparatus, because it is in such an apparatus that it is important to avoid, or at least minimise leakage of treatment liquid from one vessel to another and carry-over as the sheet material passes through the apparatus.

The apparatus may comprise at least one treatment vessel having upper and lower openings, one of the openings constituting a sheet material inlet and the other of the openings constituting a sheet material outlet. A substantially vertical sheet material path through the vessel may thus be defined by the inlet and outlet and by the nip.

The reaction surface towards which the path-defining roller is biased to define the nip will usually be the surface of another path-defining roller, or the reaction surface may be in the form of a belt or a fixed surface with a low friction coefficient. Where this general description refers to the use of two path-defining rollers, it is to be understood that the second path-defining roller may be replaced by any other reaction surface, such as those referred to above.

The sealing roller may have a diameter less than that of the path-defining roller. For example, the sealing roller may have a diameter which is from one tenth to one third of the diameter of the path-defining roller, thereby enabling the torque which needs to be applied to be further reduced. The sealing roller preferably extends in a straight line parallel to the associated path-defining roller axis and preferably contacts the surface of the associated path-defining roller at a location which is between 45° and 315°, most preferably between 80° and 100° from the centre of the nip, on the fluid side.

The sealing roller may be formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni-PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the vessel. The longitudinal bearing may have face-to-face contact with the sealing roller over at least two contact regions, which are located, for example, at from ±120° to 150° relative to the line joining the centres of a path-defining roller and its associated sealing roller, such as ±135° to that line. The width of contact between a sealing roller and its associated longitudinal bearing in each contact region is, for example, from 20° to 40° of the circumference of the sealing roller, which in the case of a sealing roller having a diameter of 8 mm may be about 2 mm per contact region.

The surface of the sealing roller opposite to the path-defining roller may be in contact with one or more fixed sealing members carried in, or formed as part of, the longitudinal bearing. The fixed sealing member may, for example, be retained within a longitudinal groove formed in the longitudinal bearing. The fixed sealing member may have a symmetrical profile section but a non-symmetrical profile section is also possible, its shape and resilience taking into account the hydrostatic and hydrodynamic pressures in the vessel and the interacting forces with the sealing roller, allowing for the fact that the path-defining roller and the sealing roller may be adapted to rotate in both directions.

The fixed sealing member which is carried in, or formed as part of, the longitudinal bearing preferably exerts a pressure on the sealing roller which is at least $\rho*g*h$, most preferably at least $2\rho*g*h$, where $\rho$ is the density of the treatment liquid (typically up to 1200 kg/m$^3$), g is 9.8 m/s$^2$ and h is the height of the treatment liquid above the sealing point. To reduce friction at this point, the contact surface between the fixed sealing member and the sealing roller is kept to a minimum. It is also desirable to establish a sealing pressure between the path-defining roller and the sealing roller. While this should preferably also exceed $\rho*g*h$ and most preferably $2\ \rho*g*h$, the absolute force applied by the path-defining roller to the sealing roller should be greater than the absolute force exerted by the fixed sealing member on the sealing roller to ensure that the sealing roller touches the bearing surfaces of the longitudinal bearing. This enables the absolute force exerted by the sealing roller on the bearing surfaces to be reduced to a minimum thereby reducing the friction at this point. The pressure exerted by the path-defining roller on the sealing roller may be derived from the mounting of the sealing roller or simply from compression of the elastomeric material covering of the associated path-defining roller or from spring forces exerted on the path-defining roller.

It is preferred that the end faces of the sealing roller and fixed sealing member extend beyond the end faces of the elastomeric part of the path-defining roller. In this way the sealing function is less dependant on tolerances and differential thermal expansion of these components and their thermal expansion relative to the path-defining roller, more precisely between the end faces of the path-defining roller. That is, it is preferred that the stationary sealing member is longer than the associated path-defining roller, and further that the contact surfaces of the longitudinal bearing with the sealing roller are shorter than the associated path-defining roller.

Preferably, the path-defining roller comprises a core carrying an elastomeric material covering, although it is possible for the path-defining roller to be elastomeric throughout its cross-section. By the term "core" we mean an axially inner member, which is usually cylindrical and which is relatively rigid compared to the elastomeric material covering. The core may be solid or hollow. Usually, drive to the roller will be applied to the core. In a preferred embodiment of the invention, each of the ends of the elastomeric material covering are in sealing contact with a surface of the end plates. The surface of each end plate may be formed of, or coated with, a low friction material such as polished metal, or polytetrafluoroethylene. The elastomeric material may extend beyond the ends of the core, the sealing means being in contact with the end faces of the covering. The extension of the covering beyond the end of the core defines a space into which the elastomeric material of the covering may be deformed as a result of a sealing force between the covering and the end plate. Such an arrangement improves the sealing between the path-defining roller and the end plate. In a preferred embodiment of the invention, the roller comprises an inner layer of elastomeric material having a relatively low hardness, and an outer region of elastomeric material having a relatively high hardness positioned over the inner layer. Such a roller minimises carry-over between vessels without damage to the sheet material while being capable of successfully being used as a drive roller. Such a path-defining roller exhibits good stability against treatment liquids and has good processing qualities.

It is a preferred feature of the present invention that the end faces of one path-defining roller lie in substantially the same planes as the end faces of the other path-defining roller. By the term "end face" we mean the face at the end of the roller, adjacent the outer surface thereof. Thus, where the roller comprises a core provided with an elastomeric material, the term "end face" as used herein means the end face of the elastomeric material covering. In this embodiment, an end face of one roller lies in exactly the same plane as an end face of the other roller, or in such a closely adjacent plane that an effective seal can be made between the end faces and the end plate or other stationary body fixed to the housing of the apparatus, taking into account any resilience in the material of which the roller and the end plate may be formed. As a consequence of this requirement, the elastomeric part of the path-defining rollers are substantially equal in length.

The end plates are preferably biased against the end faces of the path-defining rollers with a force of from 2 to 500 g/cm of contact between the end plate and the end face of the roller, measured on the surface of the roller. The pressure between the end face of the path-defining roller and the end plate should also be at least $\rho*g*h$. We prefer that the pressure between the end face of the path-defining roller and the end plate should be at least $2\rho*g*h$. Thus, the end plates may be urged against the end faces of the path-defining rollers by springs so shaped to ensure the desired location of the contact line between the end plates and the end faces of the rollers. Alternatively the elastomeric material covering of the path-defining rollers is somewhat oversized, the necessary spring force then being derived from the elasticity of the elastomeric material itself.

One or both of the path-defining rollers may constitute a drive roller for driving the sheet material along the sheet material path. Alternatively, the path-defining rollers may be freely rotating, alternative drive means being provided to drive the photographic sheet material through the apparatus.

The path-defining rollers may be biased together by a variety of methods, for example by making use of the intrinsic elasticity of the elastomeric material, by the use of fixed path-defining roller bearings. Alternatively, use may be made of resilient means such as springs which act on the ends of the path-defining roller shafts. The springs may be replaced by alternative equivalent compression means, such as e.g. a pneumatic or a hydraulic cylinder.

Each vessel of the apparatus according to the invention may be of modular construction and be provided with means to enable the vessel to be mounted directly above or below an identical or similar other vessel. Alternatively, the apparatus may take an integral form or semi-integral form. By the term "semi-integral form" we intend to include an apparatus which is divided by a substantially vertical plane passing through all the vessels in the apparatus, particularly the plane of the sheet material path, enabling the apparatus to be opened-up for servicing purposes, in particular to enable easy access to the path-defining rollers.

The apparatus according to the invention may include a substantially closed connection between adjacent vessels.

Each vessel of the apparatus may comprise a housing having an upper housing part and a lower housing part, the upper housing part being so shaped in relation to the lower housing part of the next higher vessel as to provide the substantially closed connection between adjacent vessels. For example, the upper and lower housing wall parts may be provided with flanges, means being provided to secure the flange of the upper housing wall part with the flange of the lower housing wall part of the next higher vessel thereby to provide the substantially closed connection. Optionally, a gasket may be positioned between the vessels to improve the reliability of this connection.

The top-most liquid-containing vessel of the apparatus is preferably provided with closure means for reducing the evaporation, oxidation and carbonisation of treatment liquid therefrom (and any other undesirable exchange between the treatment liquid and the environment).

The upper part of the housing of each vessel (optionally other than the top-most) is preferably so shaped as to define a leakage tray so positioned that any treatment liquid which passes, for example, through the path-defining roller nip of the next higher vessel drips from the path-defining rollers of that vessel and falls into the leakage tray, for collection and recirculation as desired.

By the use of a vertical configuration, the cross-section of the vessel can be low, such as less than 3 times the path-defining roller diameter. The volume of the vessel can therefore be low. Indeed, for a given sheet material path length, the volume of one vessel of a vertical processing apparatus can be many times smaller than the volume of an equivalent treatment bath in a horizontal processing apparatus. This has advantages in terms of the volume of treatment liquids used and the efficiency of their interaction with the sheet material.

Nevertheless, one or more of the vessels of the apparatus may include additional features if desired. Cleaning means may be provided for acting upon the path-defining rollers to remove debris therefrom, as described in European patent application EP 93202862 (Agfa-Gevaert NV), filed Oct. 11, 1993. Additional path-defining rollers, such as a path-defining roller pair or staggered path-defining rollers may be provided for transporting the sheet material through the apparatus, and these path-defining rollers will normally be driven path-defining rollers. Additional roller pairs may be provided for breaking the laminar fluid at the surface of the sheet material as it passes through the apparatus, and these rollers may be driven rollers or freely rotating rollers. Even when additional roller pairs are present, the path-defining rollers will usually constitute the lower roller pair, serving to close the lower opening of the vessel. Spray means may be provided for applying treatment liquid to the sheet material. Guide means may be included for guiding the passage of the sheet material through the apparatus. Heating means may be provided in one or more vessels so that the vessel becomes a sheet material drying unit, rather than a wet treatment unit. While liquid pumping, heating, cooling and filtering facilities will normally be provided outside the vessels, it is possible for some elements of these features to be included in the vessels themselves. Any combination of these additional features is also possible.

In one embodiment of the invention, one or more of the vessels includes at least one passage through the housing thereof to constitute an inlet and/or outlet for treatment liquid into and/or from the associated vessel. One or more vessels may not contain processing liquid, these vessels providing a dead space where diffusion reactions can occur on the sheet material as it passes there-through.

As the sheet material leaves a given liquid treatment vessel it is necessary to remove any liquid carried on the sheet material as efficiently as possible, to reduce edge effects which arise from non-homogeneous chemistry on the sheet material after squeegeeing. To do this job properly, the path-defining rollers must exert a sufficient and homogeneous pressure over the whole width of the sheet material. Also, to reduce edge effects, it is desirable that the opposite path-defining roller surfaces are in contact with each other beyond the edges of the sheet material. To put this problem in context, path-defining rollers used in conventional processing apparatus for example having a length of 400 mm to 2000 mm or more and a diameter of from 20 to 60 mm. The sheet material typically has a width of from a few millimetres up to 2 m and a thickness of 0.05 mm to 0.5 mm. In view of the nature of elastomeric material, it is in fact impossible to totally eliminate any gap between the path-defining roller surfaces at the edges of the sheet material as it passes through the nip. It is desirable that the path-defining roller surfaces be in contact with each other within as short a distance as possible from the edges of the sheet material i.e. that the size of the leak zone should be minimised. It is important however that the force between the path-defining rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the path-defining roller to its length is above a critical limit.

To enable this objective to be achieved, the ratio of the diameter of the path-defining roller to its length should be above a critical limit. In particular, at least one of the path-defining rollers, and preferably each path-defining roller, comprises a rigid core carrying a covering of elastomeric material, the ratio ($\phi$/L) of the maximum diameter ($\phi$) of the elastomeric material covering to the length (L) thereof being at least 0.012, most preferably between 0.03 and 0.06. Preferably both path-defining rollers conform to this requirement, although it is possible that the diameters ($\phi$), and therefore the ratios ($\phi$/L), of the two path-defining rollers need not be identical.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber, nitrile-butyl rubber, PFA and Fluor-Latex (FLC) materials. The hardness of the elastomeric material may be between 15 Shore (A) and 90 Shore (A), as measured on the roller surface. Where the elastomeric material comprises an inner layer of relatively low hardness and an outer layer of relatively high hardness, the inner layer should have a hardness of less than 50 Shore A, while the outer layer should have a hardness of more than 25 Shore A.

In one embodiment, the diameter ($\phi$) of the elastomeric material covering is constant along the length of the path-defining roller. Alternatively the path-defining roller may have a radial dimension profile which varies along the length thereof. In the latter case, the diameter ($\phi$) in the expression $\phi$/L is the maximum diameter. Alternatively or additionally, the diameter of the core varies along the length thereof. Ideally, the radial dimension profile of such a path-defining roller is such in relation to the force applied by the path-defining roller to sheet material passing through the nip as to be substantially even over the width thereof.

Preferably, the core has a flexural E-modulus of between 50 GPa and 300 GPa. Suitable materials for the rigid core include metals, such as stainless steel, non-ferrous alloys, titanium, aluminium or a composite thereof. In one embodiment of the invention, the core is hollow. Alternatively the core may be solid.

DETAILED DESCRIPTION OF THE INVENTION

The invention will be described by the following illustrative embodiments with reference to the accompanying drawings without the intention to limit the invention thereto, and in which.

Although only one specific embodiment of a treatment vessel according to the invention is shown in the Figures, the invention is not restricted thereto. The apparatus for the wet processing of photographic sheet material such as X-ray film as shown in the Figures comprises a plurality of treatment vessels mounted one above another. These vessels may be arranged to provide a sequence of steps in the processing of sheet photographic material, such as developing, fixing and rinsing. The vessels may be of a modular structure as shown or may be part of an integral apparatus.

Figure 1:
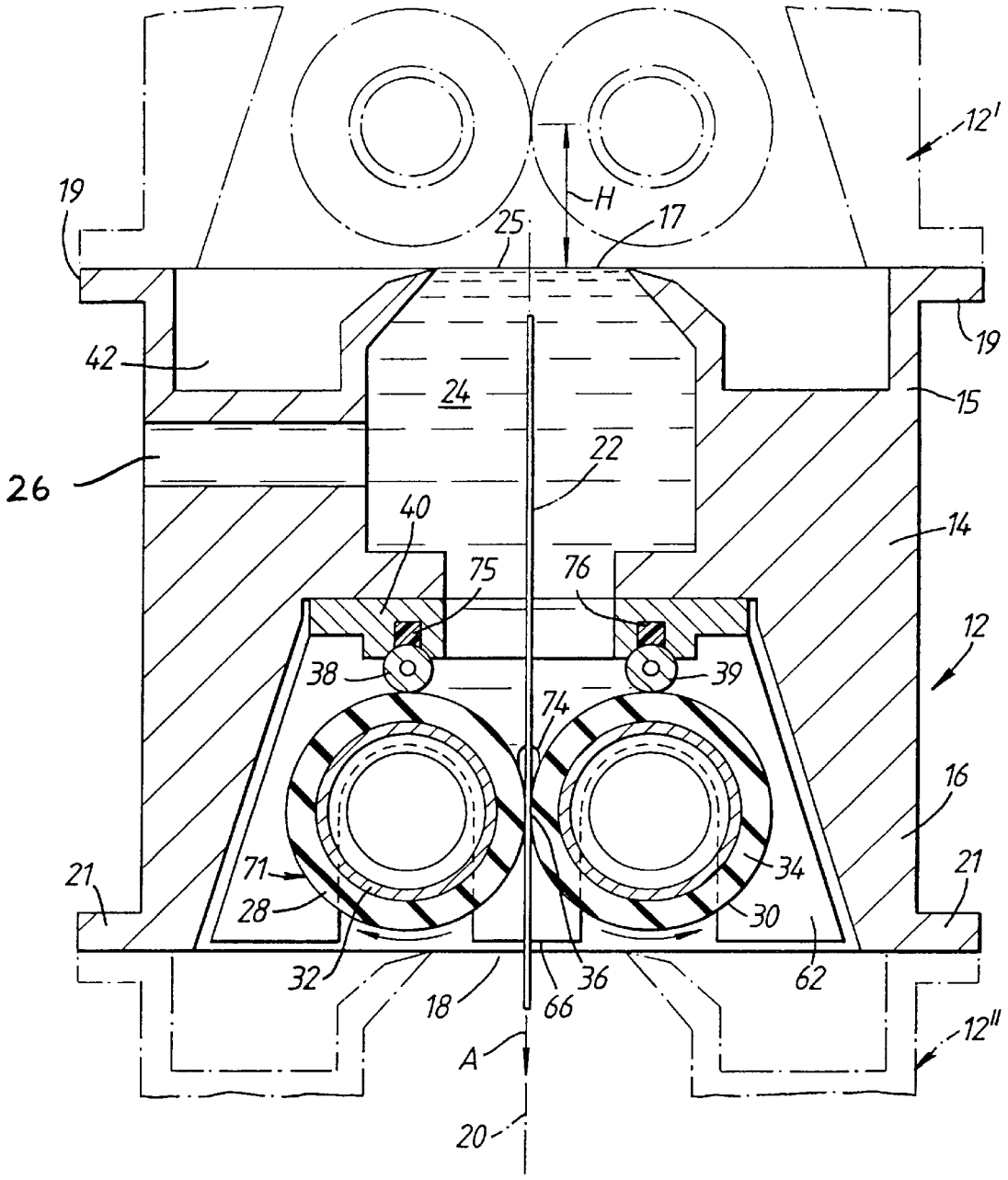
FIG. 1 is, in solid lines, a cross-sectional view of one vessel of a vertical processing apparatus according to the invention, with adjacent vessels being partly shown in broken lines.

As shown in FIG. 1, each vessel 12 comprises a housing 14 which is of generally rectangular cross-section and is so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 12, the sheet material 22 moving in a downwards direction as indicated by the arrow A. Each vessel 12 may contain treatment liquid 24, a passage 26 in the housing 14 being provided as an inlet for the treatment liquid 24.

The lower opening 18 is closed by a pair of rotatable path-defining rollers 28, 30 carried in the apparatus. Each path-defining roller 28, 30 is of the squeegee type comprising a stainless steel hollow core 32 carrying an elastomeric covering 34. The core 32 is in cylindrical form having constant internal and external diameters along the length thereof. The path-defining rollers 28, 30 are of identical length biased towards each other with a force sufficient to effect a liquid tight seal but without causing damage to the photographic sheet material 22 as it passes there-between. The line of contact between the path-defining rollers 28, 30 defines a nip 36. The nip 36 has a length which extends beyond the limits of the lower opening 18. The sheet material preferably has a width which is at least 10 mm smaller than the length of the nip 36, so as to enable a spacing of at least 5 mm between the edges of the sheet and the adjacent limit of the nip, thereby to minimise leakage. The path-defining rollers 28, 30 are coupled to drive means (not shown) so as to constitute drive rollers for driving the sheet material 22 along the sheet material path 20.

Figure 4:
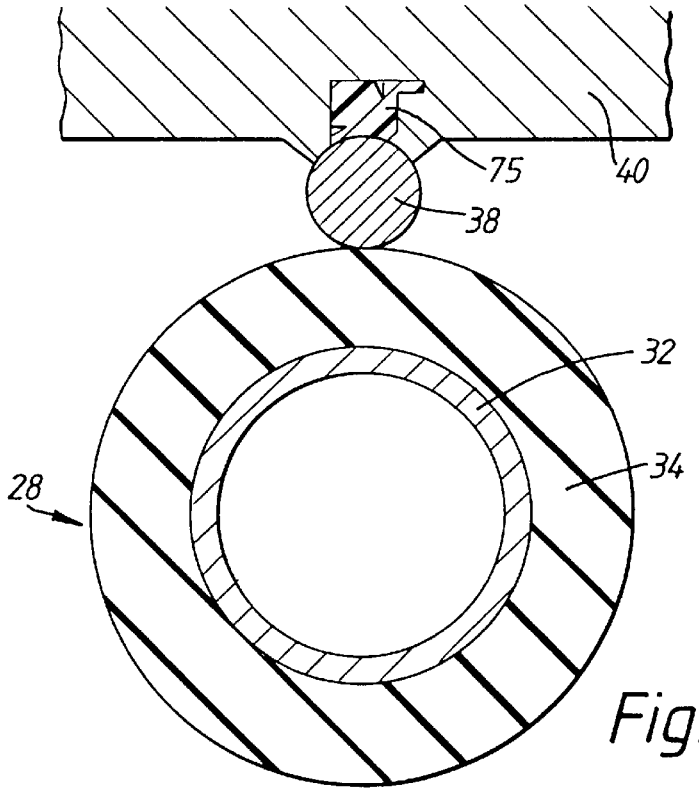
FIG. 4 is an enlarged cross-sectional view taken on the line IV—IV in FIG. 2.

Each path-defining roller 28, 30 is in sealing contact along its length, with a respective rotatable sealing roller 38, 39 formed for example of hardened or PTFE-coated metal carried by a longitudinal bearing 40, formed, for example, of high density polyethylene. As can be seen in FIG. 4, the longitudinal bearing 40 is in face-to-face contact with the sealing roller over two contact regions 80, which are positioned one on either side of a groove 81 extending along the length of the longitudinal bearing 40, the contact regions 80 being located at an angle $\alpha$ of ±135° relative to the line joining the centres of a path-defining roller 28 and the sealing roller 38. The longitudinal bearing 40 is secured to the housing 14 of the vessel 12, the treatment liquid 24 being retained in the vessel 12 by the path-defining rollers 28, 30 and the sealing rollers 38, 39. The sealing roller 38 contacts the surface 71 of the first path-defining roller 28 at a location which, in this particular embodiment, is about 90° from the centre of the nip 36 on the fluid side, that is from the plane joining the axes of rotation of the path-defining rollers 28, 30. The benefit of this arrangement is that the sealing force on the path-defining roller does not influence the bias forces between the rollers, or only influences these forces to a limited extent.

Where the apparatus is designed to operate in the opposite direction, the active forces on the path-defining roller versus the nip may be modified to take account, in particular, of the consequential differences in the reaction forces of the sealing roller on the path-defining roller in such a way that the forces on the sheet material are kept constant.

The upper and lower housing parts 15, 16 are provided with flanges 19, 21 respectively to enable the vessel 12 to be mounted directly above or below an identical or similar other vessel 12', 12", as partly indicated in broken lines in FIG. 1. The upper housing part 15 is so shaped in relation to the lower housing part 16 as to provide a substantially closed connection between adjacent vessels. Thus, treatment liquid from vessel 12 is prevented from falling into the lower vessel 12" by the path-defining rollers 28, 30 and sealing rollers 38, 39, while vapours from the lower vessel 12" are prevented from entering the vessel 12 or escaping into the environment. This construction has the advantage that the treatment liquid in one vessel 12 is not contaminated by contents of the adjacent vessels and that by virtue of the treatment liquids being in a closed system evaporation, oxidation and carbonisation thereof is significantly reduced.

The upper part 15 of the housing 14 is so shaped as to define a leakage tray 42. Any treatment liquid which may pass through the roller nip of the next higher vessel 12', in particular as the sheet material 22 passes therethrough, drips from the path-defining rollers of that vessel and falls into the leakage tray 42 from where it may be recovered and recirculated as desired. The distance H between the surface 25 of the liquid 24 and the nip of the path-defining rollers of the next upper vessel 12' is as low as possible.

Figure 2:
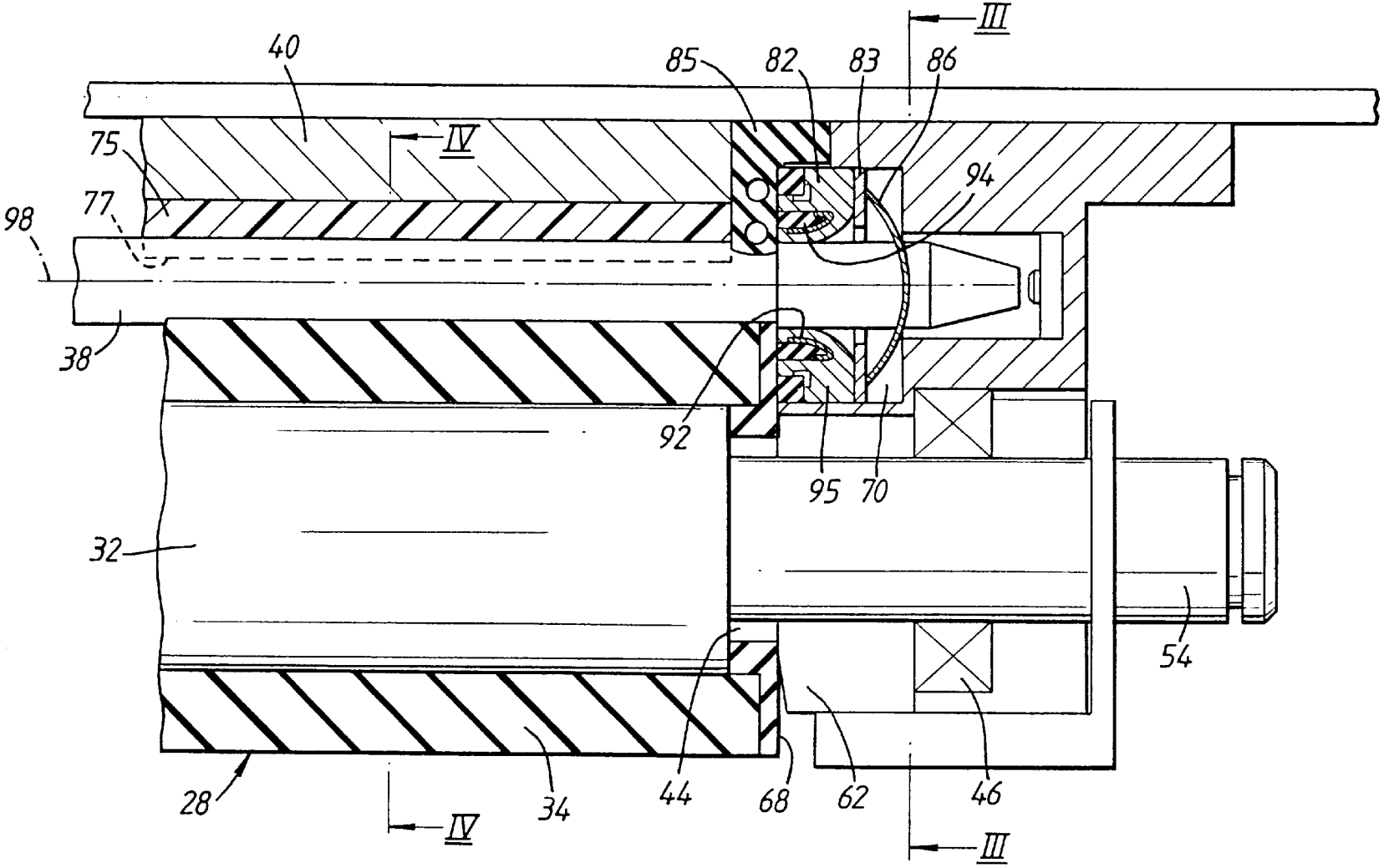
FIG. 2 is a longitudinal cross-sectional partial view showing the detail of the construction of one path-defining roller together with its associated sealing roller and fixed sealing member used in the vessel shown in FIG. 1, the view being taken on the line II—II in FIG. 3.
Figure 3:
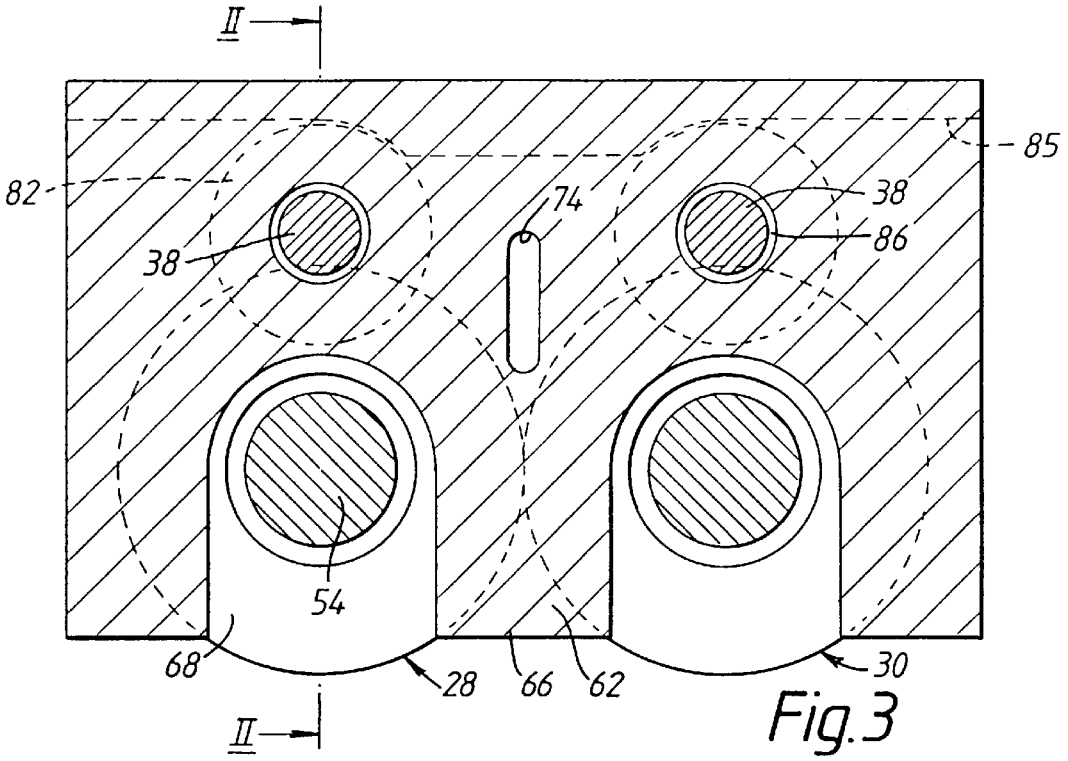
FIG. 3 is a cross-sectional view taken on the line III—III in FIG. 2.

The construction of path-defining roller 28 is shown in more detail in FIGS. 2, 3 and 4. The construction of path-defining roller 30 is similar. The roller 28 comprises a hollow core 32 of stainless steel, having a constant outside diameter of 25 mm and an internal diameter of 19 mm. The stainless steel core 32 has a flexural E-modulus of 210 GPa. The core 32 is provided with a covering 34 of EPDM rubber, an elastomer having a hardness of 30 Shore (A). The elastomeric covering 34 has a thickness varying from 7 mm and the roller ends to 7.5 mm at the roller centre. The path-defining roller 28 has a length of 750 mm and a maximum diameter of 40 mm. The maximum $\phi/L$ ratio is therefore approximately 0.053. The core 32 is welded to a roller shaft 54 which extends axially out of the roller, the free end of the roller shaft 54 being retained in a bearing 46 or coupled to a drive wheel (not shown) to provide drive to the roller.

The path-defining roller 28 is in contact with the sealing roller 38 along the length thereof. Each end of the sealing roller 38 extends into an aperture 70 formed in an end plate 62 carried on the housing 14 of the apparatus. The aperture 70 is open-sided towards the top as viewed in the Figures.

The upper surface of the sealing roller 38 is in contact with a fixed sealing member 75 in strip form, which is a pressure fit in the groove 81 of the longitudinal bearing 40 or alternatively is secured therein by means of a water- and chemical-proof adhesive. The end of the longitudinal bearing is secured to a fixed transverse sealing 85, which is provided with thermal expansion holes.

The sealing roller 38 extends beyond the end face of the covering 34 of the path-defining roller 28, the end face being vulcanised to a roller end covering 68, formed for example of EPDM containing 30% PTFE. In this way the sealing function is less dependant on tolerances and differential thermal expansion of these components and their thermal expansion relative to the path-defining roller, more precisely between the end faces of the path-defining roller. Further, the contact surfaces of the longitudinal bearing 40 with the sealing roller 38, the lower edge of which is indicated by the broken line 77, are shorter than the path-defining roller 28.

The sealing member 75 is, for example, an extruded profile of Santoprene, an extrusion of various different grades of Santoprene or an extrusion of Santoprene with polypropylene. In all these cases, the Santoprene may be foamed or unfoamed. The Santoprene may be replaced by EPDM. The polypropylene may be replaced by polybutylterephthalate (PBT). A sealing member which is a co-extrusion of EPDM with PBT is also possible. Fillers may be included in the sealing material. The sealing member should have good chemical resistance and durability.

In an alternative embodiment, the sealing member 75 is co-extruded with the longitudinal bearing 40, especially if formed of polyethylene or polypropylene. As can be seen in FIG. 1, a similar sealing member 76 is in contact with the second sealing roller 39.

The end covering 68 of the path-defining roller 28 is in contact with the end plate 62. The covering 34 extends beyond the end of the core 32 to define a space 44 into which the elastomeric material of the end covering 68 may be deformed as a result of a sealing force between the end covering 68 and the sealing roller 38 on the one hand and the end plate 62 on the other.

The path-defining rollers 28, 30 are positioned relative to each other such that end face of the first roller 28 lies in the same plane as end face of the other roller 30. Each roller is in sealing contact, not only along its length with the respective sealing roller 38, 39 but also by its end faces with the end plate 62. The end plate 62 is so shaped as to have a lower edge 66 which follows a circumferential line around the shaft 54 of the first path-defining roller 28 and a circumferential line around the shaft of the second path-defining roller 30 to enable the end plate 62 to be in face-to-face contact with the end covering 68 of the first path-defining roller 28. At its lowest point, the edge 66 is below the level of the nip 36. The circumferential distance over which the end plate 62 is in contact with the end face of the first path-defining roller 28 and the end face of the second roller 30 is as low as possible, but is larger than the circumferential distance between the nip 36 and the sealing roller 38.

The end plates 62 are urged against the end faces of the path-defining rollers 28, 30 by springs (not shown). A suitable spring force is from 2 to 500 g/cm of contact between the end plate 62 and the end covering 68 of the roller 28 measured at the surface of the roller. The pressure between the end face of the path-defining roller 28 and the end plate 62 is at least $2\rho*g*h$, which in the case where the height of the treatment liquid above the sealing point is 0.4 m means a pressure of at least 9408 Pa. When the path defining roller has a diameter ($\phi$) of 40 mm and the width of contact between the end plate and the end face of the roller is 2 mm over an angle of 90°, a force applied to the end plate of $$\pi\phi 4*0.02*9408=5.64 \text{ N } (=45 \text{ g/cm})$$

is required to establish this pressure.

The second sealing roller 39 is similarly constructed and retained in the longitudinal bearing 40. The two sealing rollers 38, 39 and the two end plates thereby complete a continuous sealing path which, together with the roller nip 36 retains the treatment liquid 24 in the vessel 12.

The end plate 62 includes an aperture 74, the lower edge of which is positioned below the level of the top of the path-defining rollers 28, 30, enabling the bulk of the treatment liquid 24 to flow out of the vessel at each end thereof and to be recirculated as desired.

A sealing ring 82 surrounds one end of the sealing roller 38 and is urged into contact with the end face of the path-defining roller 28 by means of a sinus spring 86 acting upon a backing ring 83 in contact with the sealing ring 82. The sealing ring 82 has a configuration which, in its relaxed condition, is undersized with respect to the sealing roller and when mounted on the sealing roller exhibits a flat face 96 to the end plate 62, which is fixed to the housing.

The sealing ring 82 comprises two discrete regions, namely a sealing roller contacting region formed of PTFE 95 and sealing surface contacting regions formed of EPDM elastomer 94. The sealing ring has a composite structure, comprising a spring 92 embedded in the elastomeric material 94. The separate spring 92 is optional, so that the composite structure may simply consist of a low friction material 95 and an elastomeric material 94. It is also possible for the low friction material 95 and the elastomeric material 94 to be formed of one and the same material.

Figure 5:
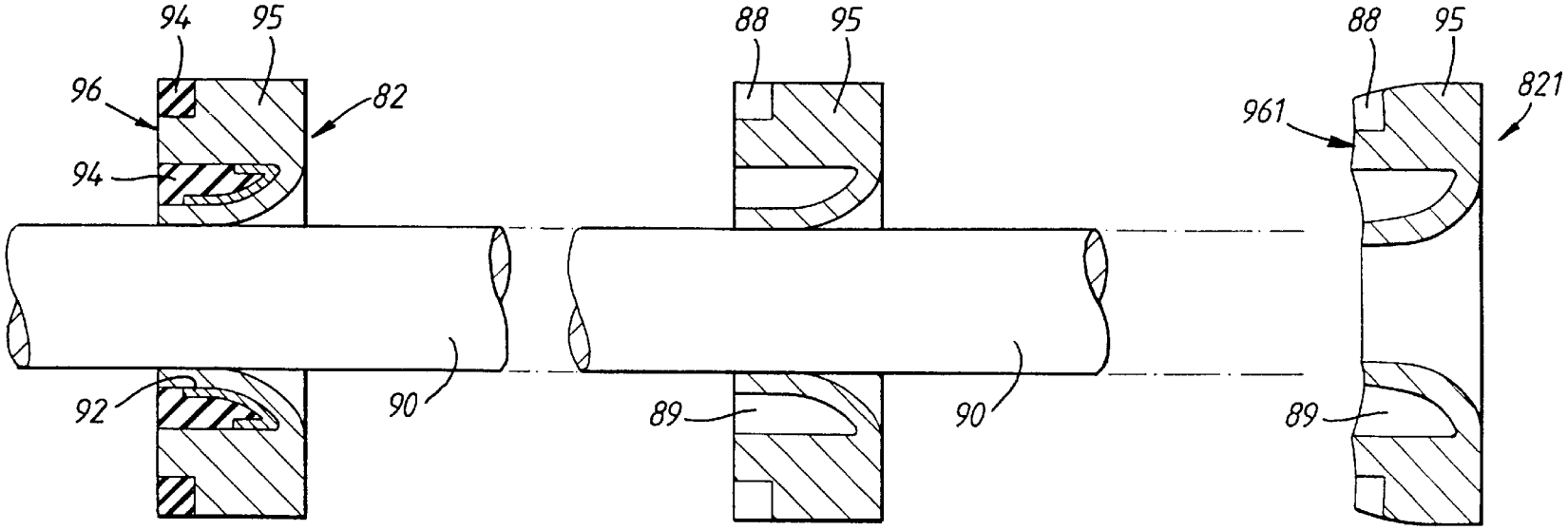
FIG. 5 illustrates the construction of the sealing ring used in the apparatus shown in FIGS. 1 to 4.

The process for constructing a sealing ring is schematically illustrated in FIG. 5. A ring-like member 821 having a non-flat end face 961, is provided, which is undersized with respect to the sealing roller 38. The ring like member 821 is formed of PTFE 95. The ring-like member 821 includes cut out portions 88, 89 opening onto an end of the ring-like member, and is forced over a mandrel 90 having a size substantiality equal to the size of the sealing roller 38. The spring 92 is inserted in cut out portion 89 and then both cut out portions 88, 89 are filled with EPDM 94 so as to provide a sealing ring with a flat end face 96. After filling the cut out portions 88, 89 with the EPDM 94 and allowing the latter to harden, and while the ring-like member 821 is still positioned over the mandrel 90, the end of the ring-like member is ground to provide the flat face 96, perpendicular, in use, to the axis 98 of the sealing roller 38.

Once the EPDM has set, the sealing ring 82 is removed from the mandrel 90 and then fitted onto one end of the sealing roller 38.

Alternatively, the sealing roller 38 is itself used as the mandrel 90.

Reference Number List

| | |
|---|---|
| vessel 12, 12', 12" | end plate 62 |
| housing 14 | lower edge 66 |
| upper part 15 | roller end covering 68 |
| lower part 16 | aperture 70 |
| upper opening 17 | surface 71 |
| lower opening 18 | aperture 74 |
| flanges 19, 21 | fixed sealing member 75 |
| path 20 | sealing member 76 |
| sheet material 22 | broken line 77 |
| arrow A | contact regions 80 |
| liquid 24 | groove 81 |
| surface 25 | sealing ring 82 |
| passage 26 | backing ring 83 |
| path-defining rollers 28, 30 | fixed transverse sealing 85 |
| core 32 | sinus spring 86 |

-continued

| Reference Number List | |
|---|---|
| covering 34 | cut out portions 88, 89 |
| nip 36 | mandrel 90 |
| sealing roller 38, 39 | spring 92 |
| bearing 40 | elastomeric material 94 |
| leakage tray 42 | PTFE 95 |
| space 44 | flat end face 96 |
| distance H | axis 98 |
| roller shaft 54 | ring-like member 821 |
| | non-flat end face 961 |

I claim:

1. A photographic sheet material liquid processing apparatus comprising a housing (14), a path-defining roller (28) mounted in said housing and biased towards a reaction surface (30) to form a nip (36) there-between through which a sheet material path (20) extends, a sealing roller (38, 39) in contact with said path-defining roller along the length thereof to seal said path-defining roller from said housing, and a sealing ring (82) which surrounds one end of said sealing roller and is urged into contact with a sealing surface (68), characterised in that said sealing ring has a configuration which, in its relaxed condition, is undersized with respect to said sealing roller and when mounted on said sealing roller exhibits a flat face (96) in the plane perpendicular to the sealing roller axis (98).

2. An apparatus according to claim 1, wherein said sealing ring has a composite structure, comprising a spring embedded in elastomeric material (94).

3. An apparatus according to claim 1, wherein said sealing ring has a composite structure comprising at least two discrete regions, namely a sealing roller contacting region formed of a material (95) of relatively low friction and a sealing surface contacting region formed of a material of relatively high elasticity (94).

4. An apparatus according to claim 3, wherein said material of relatively low friction is selected from fluorinated polymers, oxymethylene polymers, acrylic polymers and ether sulphone polymers.

5. An apparatus according to claim 3, wherein said material of relatively high elasticity is selected from ethylene/propylene/diene terpolymers, silicone rubber, polyurethane, thermoplastic rubber, styrene-butyl rubber, nitrile-butyl rubber, PFA and Fluor-Latex materials.

6. A process for constructing a sealing ring for use with a sealing roller in a photographic sheet material liquid processing apparatus, comprising forming a ring-like member (821) which is undersized with respect to said sealing roller and which includes a cut out portion (88, 89) opening onto an end of said ring-like member, forcing said ring-like member over a mandrel (90) having a size substantiality equal to the size of said sealing roller, and filling said cut out portion with elastomeric material so as to provide a sealing ring with a flat end face (96) in the plane perpendicular to the sealing roller axis (98).

7. A process according to claim 6, wherein said sealing ring (82) is removed from said mandrel (90) and then fitted onto one end of said sealing roller (38).

8. A process according to claim 6, wherein said sealing roller (38) is used as said mandrel (90).

9. A process according to claim 6, wherein, after filling said cut out portion with said elastomeric material and while the ring-like member (821) is positioned over said mandrel (90), the end of said ring-like member is ground to provide said flat face (96).

* * * * *

UNITED STATES PATENT AND TRADEMARK OFFICE

CERTIFICATE OF CORRECTION

PATENT NO. : 5,970,270

DATED : October 19, 1999

INVENTOR(S) : De Roeck

It is certified that error appears in the above-identified patent and that said Letters Patent is hereby corrected as shown below:

Title Page, After Item [22], insert:
-- [30] Foreign Application Priority Data Apr. 10,1997 European Pat. Off...97201052 --;

Column 11, line 60: "$\pi\phi 4$" should read -- $\pi\phi/4$ --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*